US005540342A

United States Patent [19]

Rathbun

[11] Patent Number: 5,540,342

[45] Date of Patent: Jul. 30, 1996

[54] TAMPER RESISTANT LID

[75] Inventor: Willard J. Rathbun, Castalia, Ohio

[73] Assignee: Rathbun Family Real Estate Group, Castalia, Ohio

[21] Appl. No.: 361,297

[22] Filed: Dec. 22, 1994

[51] Int. Cl.[6] ..... B65D 41/02

[52] U.S. Cl. ..... 215/225; 215/252; 215/256; 220/276; 220/306

[58] Field of Search ..... 215/203, 225, 215/252, 256; 220/266, 270, 276, 306

[56] References Cited

U.S. PATENT DOCUMENTS

| | | | |
|---|---|---|---|
| 228,031 | 5/1880 | Broughton | 220/270 |
| 424,982 | 4/1890 | Hidden | 220/270 |
| 3,837,518 | 9/1974 | Gach | 215/7 |
| 4,024,976 | 5/1977 | Acton | 215/32 |
| 4,111,329 | 9/1978 | Lampman | 220/266 |
| 4,190,175 | 2/1980 | Allen | 220/270 |
| 4,493,432 | 1/1985 | Smith | 220/270 |
| 4,512,493 | 4/1985 | Von Holdt | 220/306 |
| 4,646,926 | 3/1987 | Agbay et al. | 215/203 |
| 4,700,860 | 10/1987 | Li | 215/256 |
| 4,711,364 | 12/1987 | Letica | 220/276 |
| 4,718,571 | 1/1988 | Bordner | 220/270 |
| 4,807,771 | 2/1989 | Roy et al. | 215/252 |
| 4,886,184 | 12/1989 | Chamourian | 220/306 |
| 5,002,198 | 3/1991 | Smith | 220/276 |
| 5,092,478 | 3/1992 | La Pierre | 215/256 |
| 5,111,947 | 5/1992 | Patterson | 215/256 |
| 5,115,934 | 5/1992 | Nelson | 220/276 |
| 5,207,340 | 5/1993 | Cochrane | 215/256 |
| 5,271,517 | 12/1993 | Bowers | 220/276 |

FOREIGN PATENT DOCUMENTS

| | | |
|---|---|---|
| 85118 | 2/1958 | Denmark . |

*Primary Examiner*—Gary E. Elkins
*Attorney, Agent, or Firm*—Emch, Schaffer, Schaub & Porcello

[57] ABSTRACT

A snap-on tamper resistant lid having a dual locking system to retain the lid on the container. The lid has a top and a depending skirt. A plurality of beads extend inwardly from the skirt and serve as a primary locking device to retain the lid on a container. A plurality of secondary locking ribs are hinged to the skirt below the level of the beads. The secondary locking ribs have a distal end or edge biased toward the container. Upon initial installation the locking ribs are positioned below the container lip. To remove the lid one must remove the tear strip and the locking ribs. The beads still serve to secure the lid to the container.

5 Claims, 4 Drawing Sheets

TAMPER RESISTANT LID

BACKGROUND OF THE INVENTION

The present invention is directed to an improved tamper resistant lid which is mounted on a container. The container may be either a glass or plastic container. In either case, the container includes an outwardly extending return lip adjacent its upper end. This type of container is well known in the art. The lid or cap of the present invention includes two separate locking features and a tear strip which is removed by the user prior to removing the lid from the container. One of the locking devices is removed with the tear strip. The user may then remove the lid by forcing the other locking device over the return lip of the container.

U.S. Pat. No. 4,718,571 is directed to a drum structure which includes a double locking device. This patent also discloses a tear strip. This patent does not disclose a structure which is readily susceptible to automatic filling.

U.S. Pat. No. 5,115,934 is directed to a tamper resistant container lid which includes a tear strip.

U.S. Pat. No. 4,493,432 discloses a tamper evident closure having a removable lock ring which interlocks with a container lip. Once the lock ring is removed a shoulder on the closure interacts with the container lip to serve as a secondary lock.

The tamper resistant lid of the present invention provides an improved lid, which includes a secondary lock. The secondary lock is hingedly and spring-mounted, whereby automatic filling equipment may be utilized when the lids are positioned over the containers. After downward relative movement of the lid and the container has been completed, the secondary locking device has automatically sprung inwardly to its desired position below the container lip.

SUMMARY OF THE INVENTION

The present invention is directed to a tamper resistant lid for use on a container having an outwardly extending lip positioned adjacent its upper end. The lid includes a plastic top and an integral downwardly extending plastic skirt. Circumferential beads extend inwardly from the skirt and are positioned beneath the container lip, serving as a primary locking means. The inwardly directed beads define a series of circumferentially spaced receiving openings.

A circumferential tear strip is integrally mounted on the lower end of the skirt and a plurality of locking ribs extend from the tear strip. The locking ribs have a first end and a second end. The first end of each locking rib is hingedly and spring-mounted to the tear strip. Upon initial positioning of the lid on the container during assembly, the second ends of the locking ribs are positioned below the circumferential beads. This allows the tamper resistant lid including the tear strip to be installed on the container using automated filling and assembling machinery. The tamper resistant lid fits on most containers having an outwardly extending lip adjacent their upper ends. After relative movement of the lid and the container is completed, the second ends of the locking rims have automatically sprung inwardly toward the container and beneath the outwardly extending container lip where they now provide a secondary lock.

DESCRIPTION OF THE PREFERRED EMBODIMENT

Figure 1:
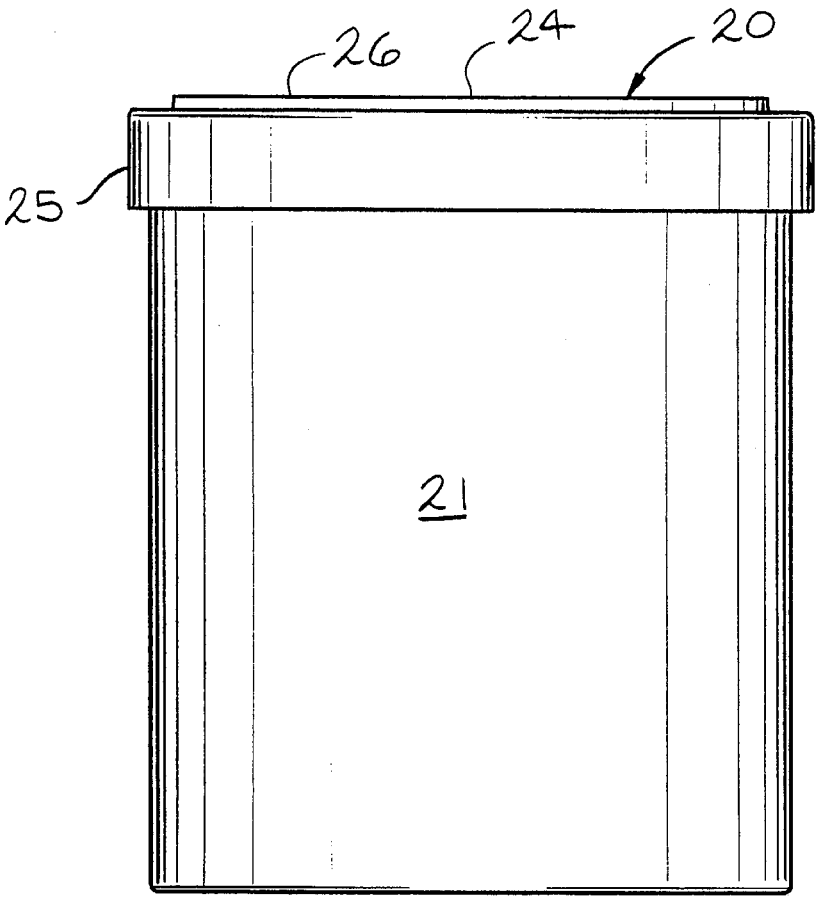
FIG. 1 is an elevational view of a tamper resistant lid, according to the present invention, mounted on a container.

A tamper resistant lid, according to the present invention, is indicated in the drawings by the reference number 20. The tamper evident lid is mounted on a container 21. The container 21 may be constructed of various materials but is normally either constructed of a plastic material or of a glass material. The tamper resistant lid 20 is preferably constructed of a plastic material. Polypropylene and polyethylene materials are preferred. The container 21 includes an outwardly extending return lip 22 adjacent its upper end.

The tamper resistant lid 20 includes a plastic top 24 and an integral downwardly extending plastic skirt 25. In the present embodiment the top 24 has a circular configuration. The top 24 includes a circular raised projection 26 which defines an interior recess 27. The skirt 25 extends circumferentially around the top 24 and has a lower end 29. A circumferential tear strip 30 is integrally mounted on the lower end 29 of the skirt 25. As is true with other tear strip prior art containers, it is possible for a retail or wholesale operation to observe if a container has been wrongfully opened.

The circular projection 26 extends upwardly from the top 24. The projection 26 in the present embodiment is used for container stacking purposes.

Figure 3:
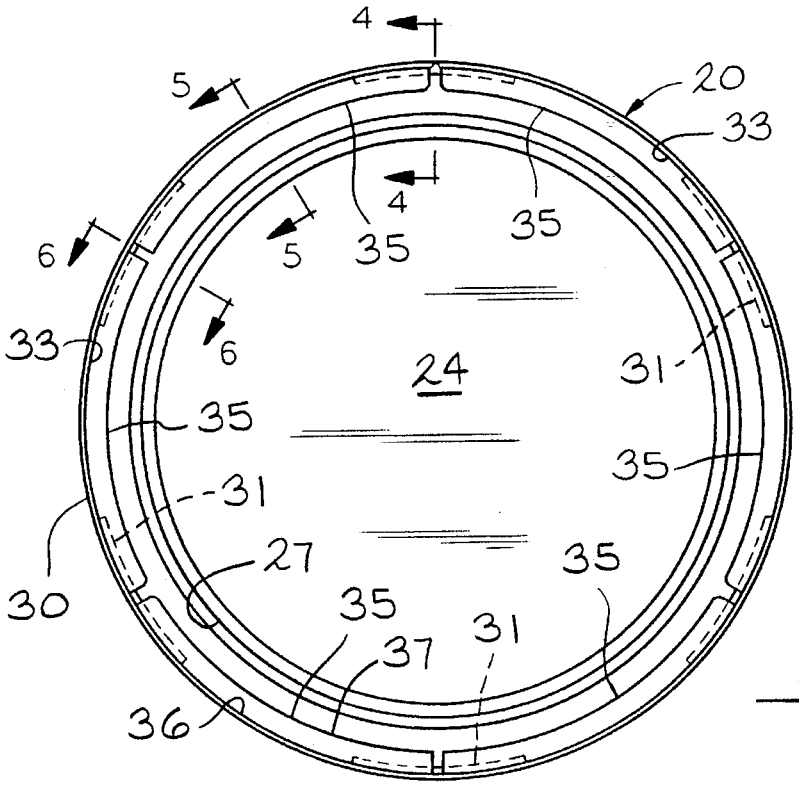
FIG. 3 is a bottom view of the tamper resistant lid.
Figure 4:
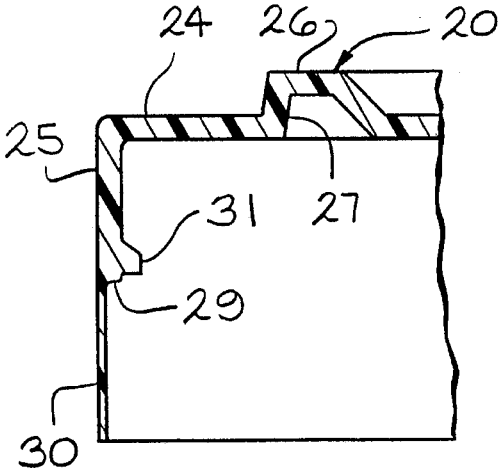
FIG. 4 is a fragmentary, cross-sectional view taken along the line 4—4 of FIG. 3 and shown on an enlarged scale.
Figure 5:
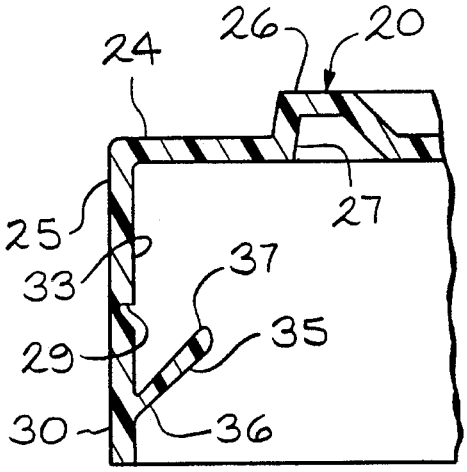
FIG. 5 is a fragmentary, sectional view similar to FIG. 4 taken along the line 5—5 of FIG. 3.
Figure 6:
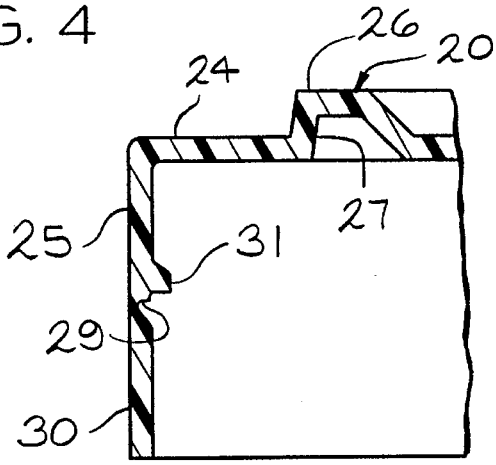
FIG. 6 is a fragmentary, sectional view similar to FIG. 4 taken along the lines 6—6 of FIG. 3.
Figure 7:
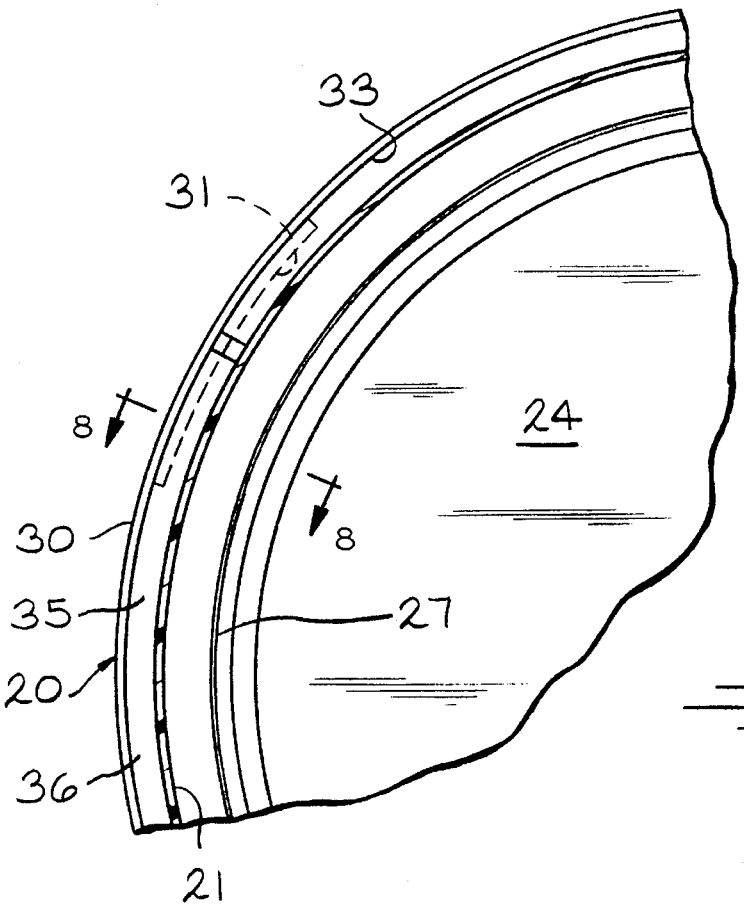
FIG. 7 is a fragmentary, cross-sectional view of the tamper resistant lid mounted on the container, looking upwardly into cap.
Figure 8:
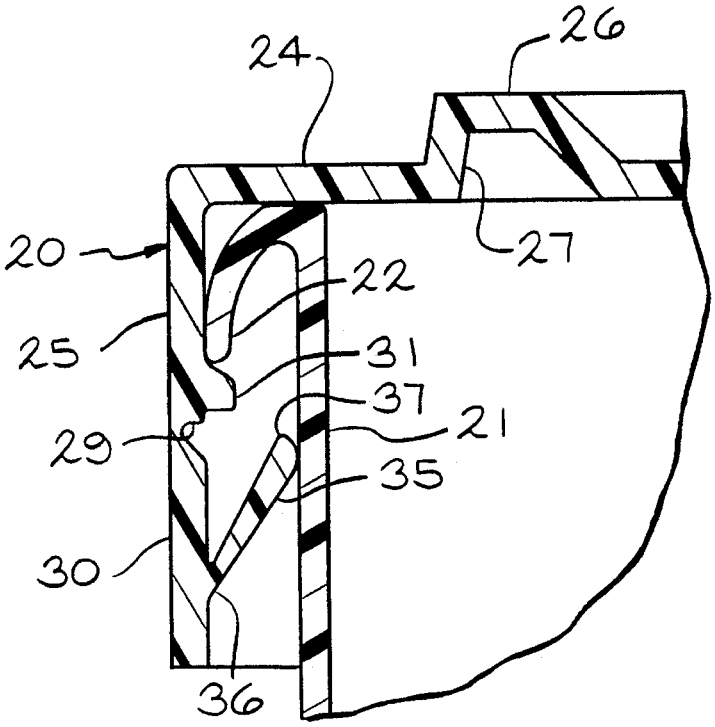
FIG. 8 is a fragmentary, cross-sectional view taken along the line 8—8 of FIG. 7 and shown on an enlarged scale.

Referring to FIGS. 4 and 6, a plurality of circumferentially positioned beads 31 extend inwardly from the skirt 25. The beads 31 are mounted on the same horizontal plane. The beads 31 serve as the primary lid locking device with respect to the container 21. As shown in FIG. 8, the beads 31 extend inwardly below the bottom of the container lip 22 to retain the lid 20 on the container 21. The beads 31 are interrupted at predetermined circumferential spacings and define a plurality of receiving openings 33 (see FIG. 3). A plurality of secondary locking ribs 35 extend inwardly from the tear strip 30.

Figure 9:
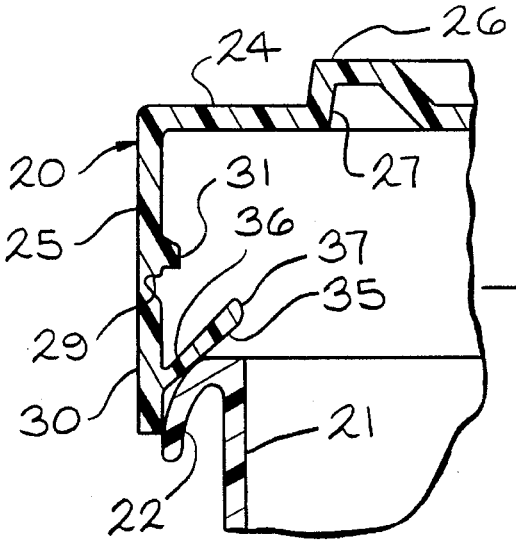
FIG. 9 is fragmentary, cross-sectional view showing a locking rib during initial installation of the tamper resistant lid on the container.
Figure 10:
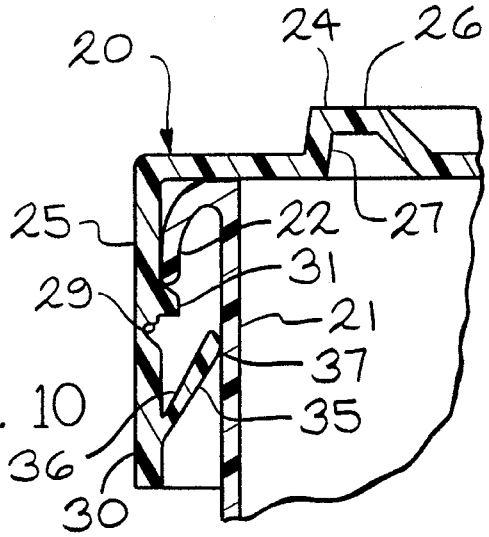
FIG. 10 is a view, similar to FIG. 9, showing the tamper resistant lid mounted on the container.
Figure 11:
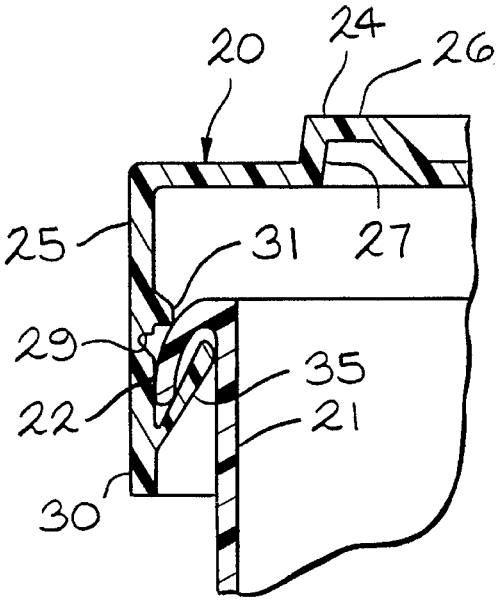
FIG. 11 is a view similar to FIG. 9 showing the locking ribs serving as a barrier to removing the tamper resistant lid from the container.

The locking ribs 35 each have a first end 36 and second end 37. An important feature of the present invention is that the first ends 36 of the locking ribs 35 are hingedly and spring-mounted with a living spring construction to the interior of the tear strip 30. In the present embodiment the first ends 36 are integral with the tear strip 30. During initial positioning of the lids 20 on containers 21, using automated equipment, the second ends 37 of the locking ribs 35 are moved upwardly as shown in FIG. 9 so that the second ends 37 of the locking ribs 35 are moved outwardly toward the skirt 25. This allows the lids 20 to be forced downwardly over the lips 22 of the containers 21. As soon as the second ends 37 of the locking ribs 35 clear the container lips 22, the locking ribs 35 by reason of their living hinges spring inwardly to the FIG. 10 position where the second ends 37 are adjacent the containers 21. After relative movement of the lids 20 and containers 21 have been completed, the second ends 37 of the locking ribs 35 have automatically sprung inwardly toward the containers 21 and beneath the outwardly extending container return lips 22 (see FIG. 10). If a person attempts to remove a lid 20 from a container 21 and manages to move the lid 20 upwardly past the primary locking beads 31, without first removing the tear strip 30, the FIG. 11 position is reached wherein the secondary locking ribs 35 are engaged beneath the container lip 22 to retard disengagement of the tamper resistant lid 20.

Figure 2:
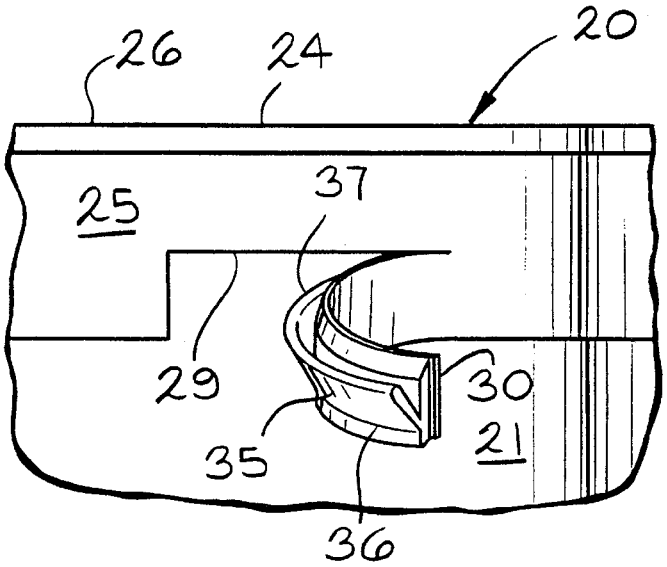
FIG. 2 is a fragmentary, enlarged perspective view, showing the tamper resistant lid mounted on a container and showing a portion of the tear strip being removed.
Figure 12:
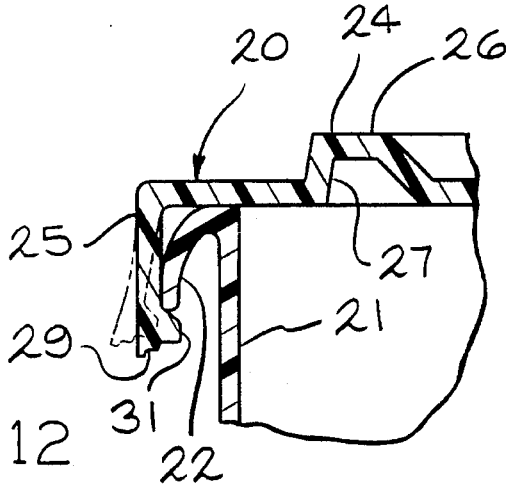
FIG. 12 is a view similar to FIG. 9 showing the circumferential beads deterring the tamper resistant lid from being removed from the container after the tear strip has been eliminated and after the lid has been replaced on the container.

When the tear strip 30 is removed as indicated in FIG. 2, the locking ribs 35 are also removed. After flexing the skirt 25 as indicated by the dashed lines in FIG. 12, the primary locking beads 31 can be moved upwardly from beneath the container lip 22, thereby allowing the temper resistant lid 20 to be removed.

It is also possible by using relatively low force to urge the lid 20, back into position on the container 21 such that the primary locking beads 31 are again positioned beneath the container lip 22. This allows a user to reseal the container 21 after the tamper resistant lid 20 is initially removed.

Many revisions may be made to the above described preferred embodiment without departing from the scope of the present invention or from the following claims.

I claim:

1. A snap-on tamper resistant lid for use on a container having an outwardly extending container lip adjacent its upper end, comprising, a top and a downwardly extending skirt integral with said top, said skirt having a lower end, a plurality of beads extending inwardly from said skirt, said beads being circumferentially mounted on said skirt, said beads being interrupted at predetermined circumferential spacings to define a plurality of openings, a tear strip mounted on said lower end of said skirt, and a plurality of segmented locking ribs extending inwardly and upwardly from said tear strip, said locking ribs having first ends and second ends, said first ends being integral with said tear strip wherein said first ends remain with said tear strip upon removal of said tear strip from said skirt, said first ends being hingedly and spring-mounted to said tear strip, whereby upon initial positioning of said lid on said container said second ends of said locking ribs are moved outwardly toward said tear strip to allow movement of said locking ribs past said container lip and wherein after relative movement of said lid and said container is completed said second ends of said locking ribs spring inwardly toward said container and beneath said outwardly extending container lip.

2. A tamper resistant lid, according to claim 1, wherein said lid has a circular top.

3. A tamper resistant lid, according to claim 1, wherein said lid is constructed of a plastic material.

4. A tamper resistant lid, according to claim 1, including a raised projection defined on the upper surface of said top.

5. A snap-on tamper resistant lid for use on a container having an outwardly extending container lip adjacent its upper end, comprising, a circular plastic top and a downwardly extending plastic skirt integral with said top, said skirt having an interior surface and a lower end, a plurality of circumferential beads extending inwardly from said skirt, said beads being circumferentially mounted on said interior surface of said skirt, said beads being interrupted at predetermined circumferential spacings to define a plurality of openings, a plastic tear strip mounted on said lower end of said skirt, and a plurality of segmented locking ribs extending inwardly and upwardly from said tear strip, said locking ribs being positioned below said beads, said locking ribs having first ends and second ends, said first ends being hingedly and spring-mounted to said tear strip, said first ends being integral with said tear strip wherein said first ends remain with said tear strip upon removal of said tear strip from said skirt, whereby upon initial positioning of said lid on said container said second ends of said locking ribs are moved outwardly toward said tear strip and beneath said beads to allow said locking ribs to travel past said container lip and wherein after relative movement of said lid and said container is completed said second ends of said locking ribs spring inwardly toward said container and beneath said outwardly extending container lip.

* * * * *